US010431869B2

(12) United States Patent
Samardzija et al.

(10) Patent No.: US 10,431,869 B2
(45) Date of Patent: Oct. 1, 2019

(54) SLOT ANTENNA IN COMPACT WIRELESS DEVICE

(71) Applicant: Plume Design, Inc., Palo Alto, CA (US)

(72) Inventors: Miroslav Samardzija, Mountain View, CA (US); Liem Hieu Dinh Vo, San Jose, CA (US); Brian Nam, San Jose, CA (US); Stan Su, Palo Alto, CA (US); Christina Xu, Palo Alto, CA (US); William Mcfarland, Portola Valley, CA (US)

(73) Assignee: Plume Design, Inc., Palo Alto, CA (US)

( * ) Notice: Subject to any disclaimer, the term of this patent is extended or adjusted under 35 U.S.C. 154(b) by 0 days.

(21) Appl. No.: 15/846,285

(22) Filed: Dec. 19, 2017

(65) Prior Publication Data

US 2019/0190115 A1 Jun. 20, 2019

(51) Int. Cl.
*H01Q 1/02* (2006.01)
*H01Q 1/22* (2006.01)
*H01Q 13/10* (2006.01)

(52) U.S. Cl.
CPC ..... *H01Q 1/02* (2013.01); *H01Q 1/2291* (2013.01); *H01Q 13/10* (2013.01)

(58) Field of Classification Search
CPC ..... H01Q 1/02; H01Q 1/2291; H01Q 1/243; H01Q 13/10; H01Q 13/103
See application file for complete search history.

(56) References Cited

U.S. PATENT DOCUMENTS

| | | | | |
|---|---|---|---|---|
| 6,473,042 | B1 * | 10/2002 | Fang | G06F 1/1616 343/700 MS |
| 6,853,197 | B1 | 2/2005 | McFarland et al. | |
| 6,961,545 | B2 | 11/2005 | Tehrani et al. | |
| 7,245,882 | B1 | 7/2007 | McFarland | |
| 7,245,893 | B1 | 7/2007 | Husted et al. | |
| 7,251,459 | B2 | 7/2007 | McFarland et al. | |
| 7,872,605 | B2 * | 1/2011 | Baliarda | H01Q 9/0421 343/700 MS |
| 9,136,937 | B1 | 9/2015 | Cheng et al. | |
| 9,160,584 | B1 | 10/2015 | Kavousian et al. | |
| 2013/0090057 | A1 | 4/2013 | Green et al. | |
| 2013/0293424 | A1 | 11/2013 | Zhu et al. | |
| 2014/0009344 | A1 | 1/2014 | Zhu et al. | |

(Continued)

*Primary Examiner* — Robert Karacsony
(74) *Attorney, Agent, or Firm* — Clements Bernard Walker PLLC; Lawrence A. Baratta, Jr.

(57) ABSTRACT

A wireless device with a slot antenna includes one or more heatsinks; one or more circuit boards with a plurality of components thereon; a housing enclosing the one or more heatsinks and the one or more circuit boards; and a slot antenna including a slot formed in or between the one or more heatsinks and an antenna feed, wherein the slot is further utilized for ventilation within the housing. The slot antenna can further include a conductive sheet placed over an end of the slot for tuning; and a dielectric material disposed in and over some portion of length of the slot, wherein the portion of the length is selected to fine tune a frequency of resonance of the slot antenna, wherein one or more components of the plurality of components are used to electrically load the slot thereby mechanically shortening a resonant length L of the slot.

20 Claims, 9 Drawing Sheets

(56) References Cited

U.S. PATENT DOCUMENTS

| | | | | |
|---|---|---|---|---|
| 2014/0009355 | A1 | 1/2014 | Samardzija et al. | |
| 2014/0112511 | A1 | 4/2014 | Corbin et al. | |
| 2014/0226572 | A1 | 8/2014 | Thota et al. | |
| 2014/0340265 | A1 | 11/2014 | Vazquez et al. | |
| 2015/0036277 | A1* | 2/2015 | Yukawa | H01Q 1/2266 361/679.22 |
| 2015/0099474 | A1 | 4/2015 | Yarga et al. | |
| 2015/0109167 | A1 | 4/2015 | Yarga et al. | |
| 2015/0195836 | A1 | 7/2015 | Malkin et al. | |
| 2015/0302976 | A1 | 10/2015 | Chang et al. | |
| 2015/0303568 | A1 | 10/2015 | Yarga et al. | |
| 2015/0311960 | A1 | 10/2015 | Samardzija et al. | |
| 2016/0056526 | A1 | 2/2016 | Li et al. | |
| 2016/0336643 | A1 | 11/2016 | Pascolini et al. | |
| 2018/0076508 | A1* | 3/2018 | Minard | H05K 1/0243 |

* cited by examiner

SLOT ANTENNA IN COMPACT WIRELESS DEVICE

FIELD OF THE DISCLOSURE

The present disclosure generally relates to antenna systems and methods. More particularly, the present disclosure relates to a slot antenna in a compact wireless device.

BACKGROUND OF THE DISCLOSURE

A slot antenna includes a metal surface (a ground plane), usually a flat plate, with one or more holes or slots cut out. When the plate is driven as an antenna by a driving frequency, the slot radiates electromagnetic waves in a way similar to a dipole antenna. The shape and size of the slot, as well as the driving frequency, determine the radiation pattern. Often the radio waves are provided by a waveguide, and the antenna includes slots in the waveguide. A slot antenna's advantages are its size, design simplicity, and convenient adaptation to mass production using either waveguide or Printed Circuit (PC) board technology. A first requirement for a slot antenna is an infinitely sized ground plane (conductor) or larger enough size compared to the wavelength ($\lambda$). A second requirement is a clearance above and below the ground plane. A third requirement is that the slit/cut/slot is close to half-wavelength to enable radiation (resonance). A fourth requirement is that the feed is positioned to minimize input reflection.

Various devices utilize antennas for wireless communication, such as wireless Access Points (APs), streaming media devices, laptops, tablets, and the like (collectively "wireless devices"). Further, the design trend for such devices is aesthetically pleasing and compact form factors. Since the slot antenna requires clearance in front and at the back of the ground plane and the slot, it is difficult to implement in a device which has a lot of components such as Radio Frequency (RF), power, heatsinks, etc. The required slot length is about $\lambda/2$ which for Bluetooth and Wi-Fi is about 60 mm which can be difficult to implement in a compact device. Also, the required optimal feed position is difficult to implement with adjacent parts in a compact design.

BRIEF SUMMARY OF THE DISCLOSURE

In an exemplary embodiment, a wireless device with a slot antenna includes one or more heatsinks; one or more circuit boards with a plurality of components thereon; a housing enclosing the one or more heatsinks and the one or more circuit boards; and a slot antenna including a slot formed in or between the one or more heatsinks and an antenna feed, wherein the slot is further utilized for ventilation within the housing. One or more components of the plurality of components can be used to electrically load the slot thereby shortening a resonant length L of the slot. The one or more components can be adjacent to the slot and there can be an air gap between the components and the one or more heatsinks acting as a capacitor across the air gap. The wireless device can further include a conductive sheet placed over an end of the slot for tuning. The conductive sheet can cover a portion of the slot for tuning the tuning based on selection of dimensions of a portion of the conductive sheet. The conductive sheet can be connected to the antenna feed. The conductive sheet can be connected to the heat sink using screws or conductive adhesive. The conductive sheet can be mounted in a varied position to change an electrical length of the slot.

The wireless device can further include a dielectric material disposed in or over some portion of length of the slot, wherein the portion of the length is selected to fine tune a frequency of resonance of the slot antenna. The wireless device can further include a conductive sheet placed over an end of the slot for tuning; and a dielectric material disposed in and over some portion of length of the slot, wherein the portion of the length is selected to fine tune a frequency of resonance of the slot antenna, wherein one or more components of the plurality of components are used to electrically load the slot thereby mechanically shortening a resonant length L of the slot.

The wireless device can further include one or more additional antennas, wherein an orientation of the slot is such that the slot antenna's radiation is largely orthogonal to the one or more additional antennas which are in a same frequency band. The one or more additional antennas can include any of a planar inverted F antenna (PIFA), an inverted F antenna (IFA), and a monopole antenna. The one or more additional antennas can be on a top side of the one or more heatsinks and the slot antenna can be on a side wall of the one or more heatsinks. A required resonant length L of the slot can be about 60 mm and is mechanically shortened to about 50 mm with a capacitive load on the slot. The slot antenna can have resonant frequencies in both the 2.4 GHz frequency band and the 5 GHz frequency band. The wireless device can further include a fan, one or more air intakes, and a ventilation point in the housing, wherein airflow in the housing utilizes the slot for ventilation.

In another exemplary embodiment, a wireless device with a slot antenna includes one or more heatsinks; one or more circuit boards with a plurality of components thereon; a housing enclosing the one or more heatsinks and the one or more circuit boards; and a slot antenna including a slot formed in or between the one or more heatsinks, an antenna feed, and a conductive sheet placed over an end of the slot for tuning. The conductive sheet can cover a portion of the slot for tuning the tuning based on selection of dimensions of a portion of the conductive sheet.

In a further exemplary embodiment, a wireless device with a slot antenna includes one or more heatsinks; one or more circuit boards with a plurality of components thereon; a housing enclosing the one or more heatsinks and the one or more circuit boards; and a slot antenna including a slot formed in or between the one or more heatsinks, an antenna feed, and a dielectric material disposed in or over some portion of length of the slot. The portion of the length can be selected to fine tune a frequency of resonance of the slot antenna.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

Figure 1:
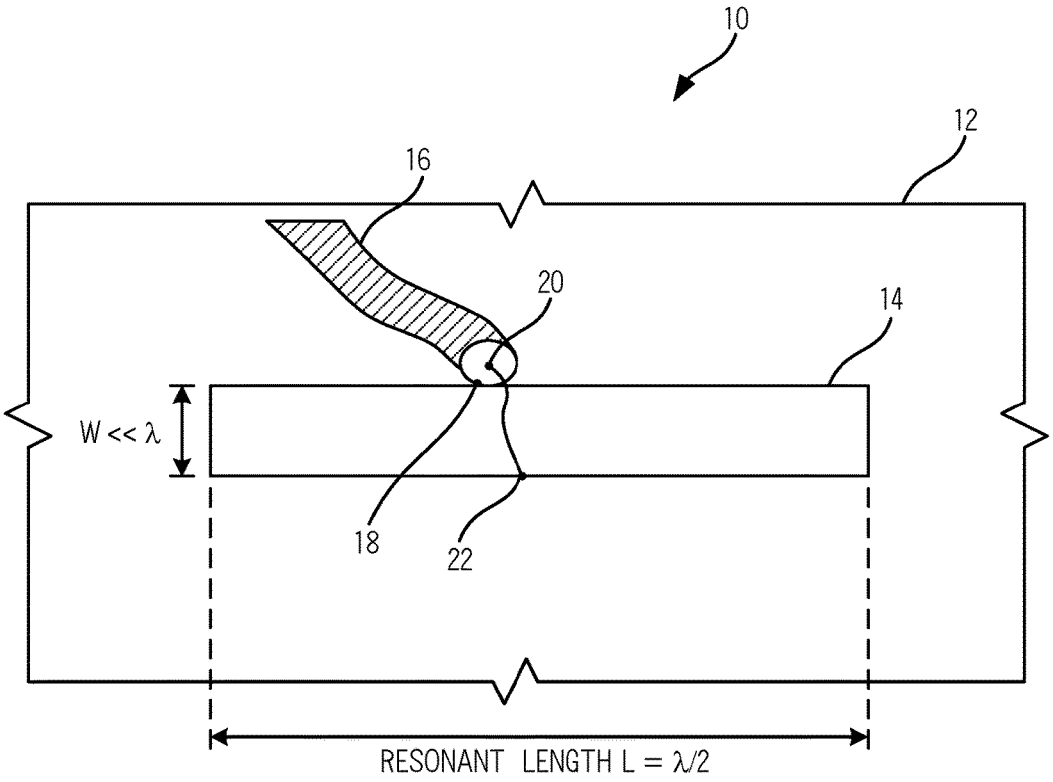
FIG. 1 is a diagram of a slot antenna.

In various exemplary embodiments, the present disclosure relates to a slot antenna in a compact wireless device. The slot antenna reuses metal associated with the product, e.g., heatsinks, etc. For example, the slot can be made in or between heatsinks and the slot can also provide ventilation for the device. Also, the slot and ground plane can be folded, i.e., conform to the physical design of the compact wireless device.

A wireless device with a slot antenna includes one or more heatsinks; one or more circuit boards with a plurality of components thereon; a housing enclosing the heatsinks and the circuit boards; and a slot antenna including a slot formed in or between the heatsinks, an antenna feed, and a ground plane formed by the heatsinks which are folded in part, wherein the slot is further utilized for ventilation within the housing. The wireless device can further include a clip placed over an end of the slot for tuning; and a dielectric material disposed in and over some portion of length of the slot, wherein the portion of the length is selected to fine tune a frequency of resonance of the slot antenna, wherein one or more components are used to electrically load the slot thereby mechanically shortening a resonant length L of the slot.

In an exemplary embodiment, components within the device are used to load the slot thereby mechanically shortening the slot electrically. For example, components behind the slot do not short all the way from top to bottom of the slot; rather there is an air gap making those components act as if they were capacitors across the gap. This loading allows the slot to be shortened. The rear component location along the slot is important, i.e., the location of feed and length of the slot all depend on the location of the component that is forming the capacitive coupling across the slot. In addition, the component should be close to the slot, so there is a short lead path to the effective capacitor across the slot.

In another exemplary embodiment, a conductive sheet is placed over an end of the slot for tuning. The conductive sheet can be a clip that covers a portion of the slot, thereby tuning the slot (allows tuning of the slot without modifying a heat sink design, but rather only by modifying dimensions of a portion of the clip). The conductive sheet can be a thin material that can be shaped easily to change the length of the slot to adjust tuning. The clip can be attached with screws or another conductive fastening (adhesive). The clip positioning can be changed, thereby changing electrical length of the slot. The clip can include an antenna feed for ease of assembly.

In a further exemplary embodiment, the slot can include dielectric material over some portion of the slot length. The length of the dielectric material can be easily adjusted in order to fine-tune the frequency of resonance. The dielectric material can be within the slot, rather than just on the outside of the slot (it has a stronger effect when in the slot). Also, the orientation of the slot is such that the radiation is orthogonal to other antennas in the same frequency band in the device design to maximize isolation from other antennas. That is, the combination of "traditional" antennas and slot antennas in the device allow orthogonality of polarization in the device that is thin (long dimension of the two types of antennas, when orthogonal goes in the same direction).

Slot Antenna

FIG. 1 is a diagram of a slot antenna 10. The slot antenna 10 includes a ground plane 12 which is large relative to the wavelength of interest (λ). The slot antenna 10 includes a slot 14 in the ground plane 12, and the slot is non-conductive. The slot 14 includes a width W which is much less than the wavelength of interest (λ) and a resonant length L which is about λ/2. A coaxial cable 16 has an outer conductor 18 which is soldered or connected to the ground plane 12 at the slot 14 and an inner conductor 20 which is soldered or connected to an opposite side 22 across the slot 14.

Example Wireless Device

Figure 2:
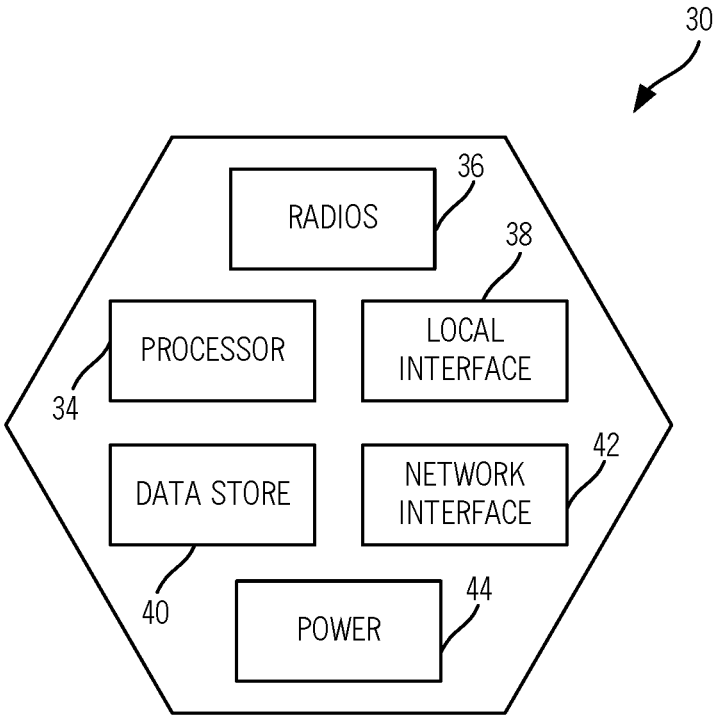
FIG. 2 is a block diagram of functional components of a wireless access point as an example wireless device implementing the slot antenna described herein.
Figure 3:
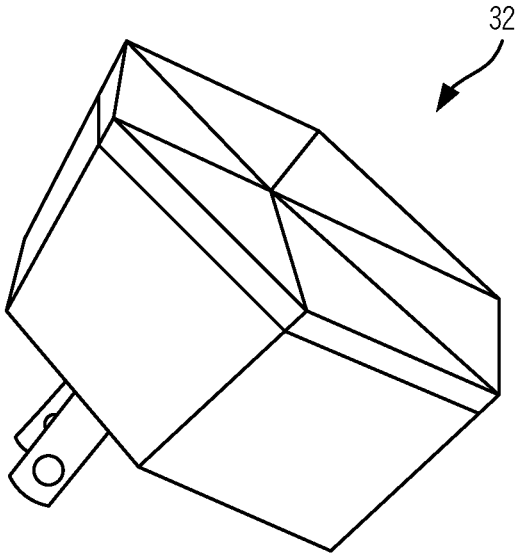
FIG. 3 is a perspective diagram of a physical form factor for the wireless access point.

FIG. 2 is a block diagram of functional components of a wireless access point 30 as an example wireless device implementing the slot antenna described herein. FIG. 3 is a perspective diagram of a physical form factor 32 for the wireless access point 30. The access point 30 includes the physical form factor 32 which contains a processor 34, a plurality of radios 36, a local interface 38, a data store 40, a network interface 42, and power 44. It should be appreciated by those of ordinary skill in the art that FIG. 2 depicts the access point 30 in an oversimplified manner, and a practical embodiment may include additional components and suitably configured processing logic to support features described herein or known or conventional operating features that are not described in detail herein.

In an exemplary embodiment, the form factor 32 is a compact physical implementation where the access point 30 directly plugs into an electrical socket and is physically supported by the electrical plug connected to the electrical socket. This compact physical implementation is ideal for a large number of access points 30 distributed throughout a residence. The processor 34 is a hardware device for executing software instructions. The processor 34 can be any custom made or commercially available processor, a central processing unit (CPU), an auxiliary processor among several processors, a semiconductor-based microprocessor (in the form of a microchip or chip set), or generally any device for executing software instructions. When the access point 30 is in operation, the processor 34 is configured to execute software stored within memory or the data store 40, to communicate data to and from the memory or the data store 40, and to generally control operations of the access point 30 pursuant to the software instructions. In an exemplary embodiment, the processor 34 may include a mobile-optimized processor such as optimized for power consumption and mobile applications.

The radios 36 enable wireless communication. The radios 36 can operate according to the IEEE 802.11 standard. The radios 36 include address, control, and/or data connections to enable appropriate communications on a Wi-Fi system. As described herein, the access point 30 includes a plurality of radios to support different links, i.e., backhaul links and client links. In an exemplary embodiment, the access point 30 can support dual-band operation simultaneously operating 2.4 GHz and 5 GHz 2×2 MIMO 802.11b/g/n/ac radios having operating bandwidths of 20/40 MHz for 2.4 GHz and 20/40/80 MHz for 5 GHz. For example, the access point 30 can support IEEE 802.11AC1200 gigabit Wi-Fi (300+867 Mbps). Also, the radios 36 can include a Bluetooth interface as well for local access, control, onboarding, etc. The radios 36 contemplate using the slot antenna structure described herein.

The local interface 38 is configured for local communication to the access point 30 and can be either a wired connection or wireless connection such as Bluetooth or the like. Since the access point 30 can be configured via the cloud, an onboarding process is required to first establish connectivity for a newly turned on access point 30. In an exemplary embodiment, the access point 30 can also include the local interface 38 allowing connectivity to a user device for onboarding to a Wi-Fi system such as through an app on the user device. The data store 40 is used to store data. The data store 40 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 40 may incorporate electronic, magnetic, optical, and/or other types of storage media.

The network interface 42 provides wired connectivity to the access point 30. The network interface 42 may be used to enable the access point 30 communicate to a modem/router. Also, the network interface 42 can be used to provide local connectivity to a user device. For example, wiring in a device to an access point 30 can provide network access to a device which does not support Wi-Fi. The network interface 42 may include, for example, an Ethernet card or adapter (e.g., 10BaseT, Fast Ethernet, Gigabit Ethernet, 10 GbE). The network interface 42 may include address, control, and/or data connections to enable appropriate communications on the network. The processor 34 and the data store 40 can include software and/or firmware which essentially controls the operation of the access point 30, data gathering and measurement control, data management, memory management, and communication and control interfaces with the cloud.

Large Ground Plane in Compact Design

The physical form factor 32 can be relatively small and compact. For example, the dimensions of the physical form factor 32 can be about 64 mm×58 mm×34 mm (L×W×H). As described herein, the slot 14 resonant length L for Wi-Fi and/or Bluetooth is about 60 mm. This is problematic in the context of the physical form factor 32 which does not have a side for the ground plane 12 and the slot 14 of about 60 mm.

Figure 4:
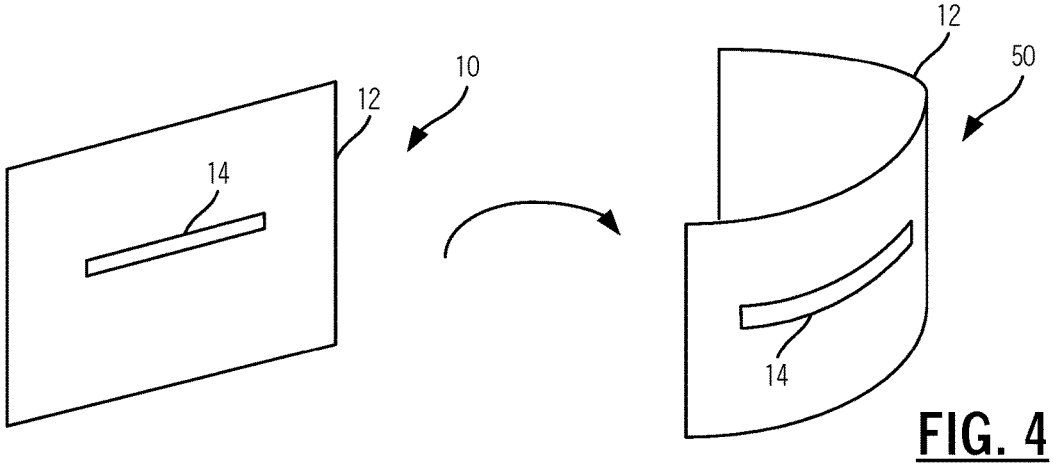
FIG. 4 is a diagram illustrating a slot antenna formed through a folded ground plane.
Figure 5:
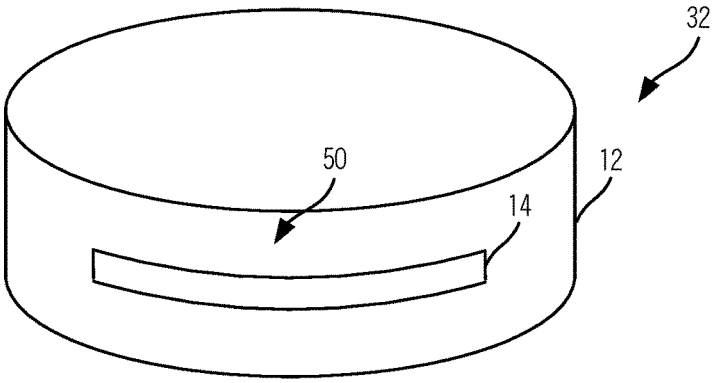
FIG. 5 is a perspective diagram of a wireless device with the slot antenna formed therein.

FIG. 4 is a diagram illustrating a slot antenna 50 formed through a folded ground plane 12. FIG. 5 is a perspective diagram of a wireless device 50 with the slot antenna 50 formed therein. Specifically, the slot antenna 50 can include heatsinks in the form factor 32 with the slot 14 therein. The slot antenna 50 can fold in the shape of the form factor 32. For example, the form factor 32 can be a cylinder, prism, rectangle, square, etc. The ground plane 12 can be the heatsinks which have a shape, and the slot 14 can be folded therein.

Folded Slot Antenna

Figure 6:
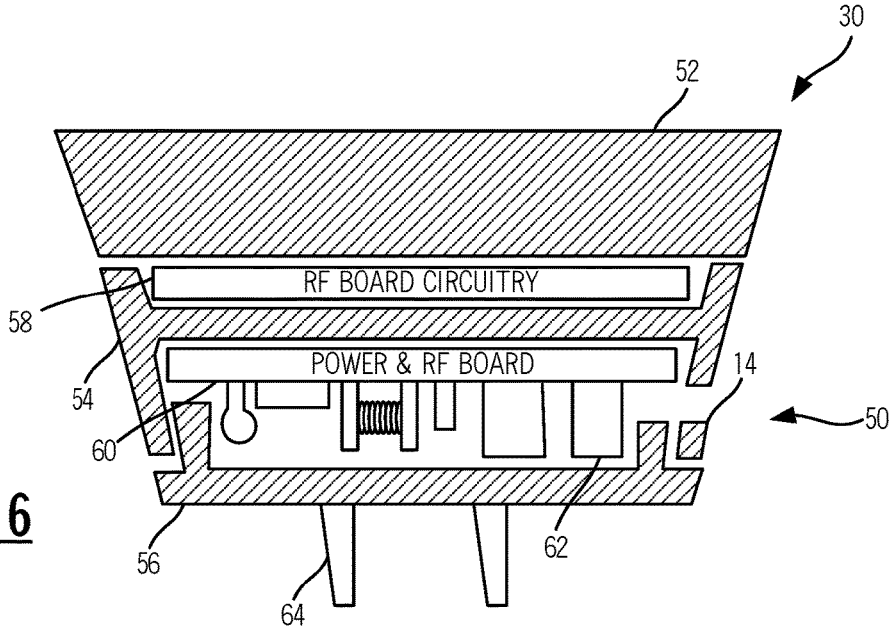
FIG. 6 is a cross-sectional view of the wireless access point with the slot antenna formed therein.

FIG. 6 is a cross-sectional view of the wireless access point 30 with the slot antenna 50 formed therein. The wireless access point 30 includes a top heatsink 52, a mid heatsink 54, and a bottom heatsink 56. The wireless access point 30 also includes an RF board 58 with circuitry thereon, and a power and RF board 60 with various components 62 disposed thereon. Further, the wireless access point 30 can include a wall plug 64 for insertion into an electrical outlet. The heatsinks 52, 54, 56 are DC connected (metal-to-metal) even though this is not shown in FIG. 6 and the boards 58, 60 are also DC connected to the heatsinks 52, 54, 56.

The slot antenna 50 can be formed with the ground plane 12 being the heatsinks 52, 54, 56 and with the slot 14 formed in the heatsink 54. The components 62 can include transformers, capacitors, etc. As described herein, the components 62 can be used to electrically load the slot 14 thereby mechanically shortening the slot 14 length. The components 62 behind the slot 14 do not short all the way from top to bottom of the slot 14; rather there is an air gap making those components 62 act as if they were capacitors across the gap. This loading allows the slot 14 to be shortened. A rear component location along the slot 14 is important—the location of feed and length of the slot all depend on the location of the component that is forming the capacitive coupling across the slot 14. In addition, the component should be close to the slot 14, so there is a short lead path to the effective capacitor across the slot 14.

Figure 7:
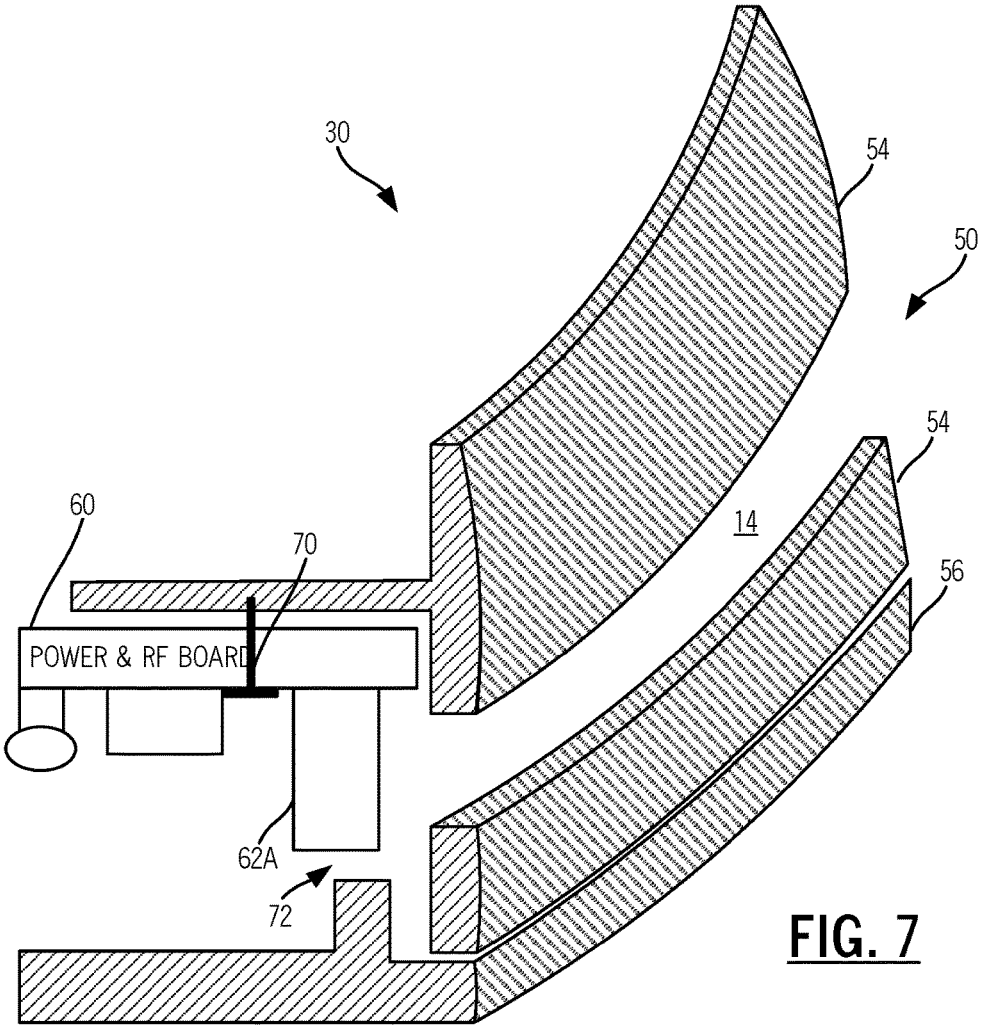
FIG. 7 is a perspective diagram of the wireless access point with the slot antenna formed therein.
Figure 8:
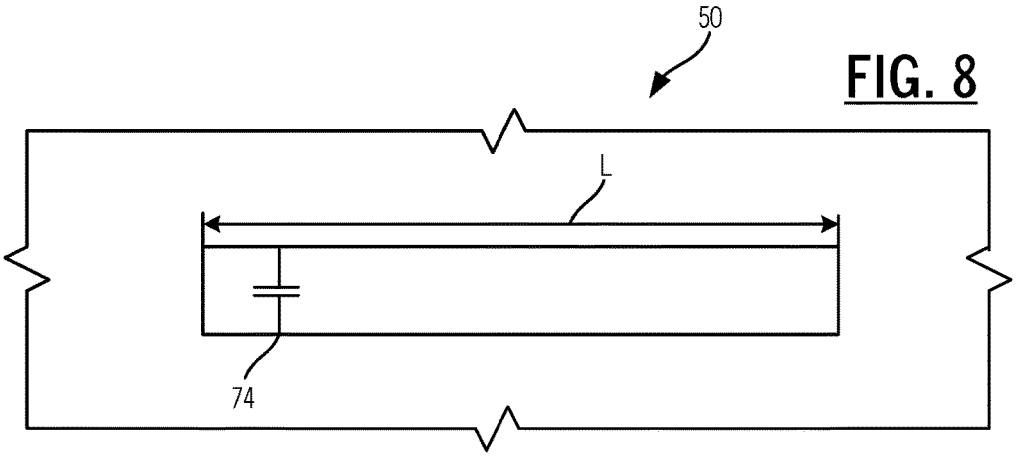
FIG. 8 is a schematic diagram of the slot antenna of FIG. 7.
Figure 9:
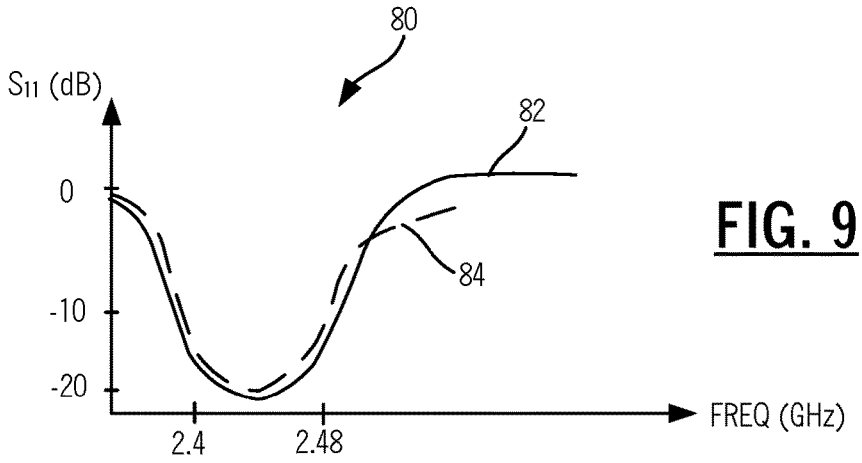
FIG. 9 is a graph of the S11 parameter illustrating the effect of a capacitive load in FIGS. 7 and 8.

FIG. 7 is a perspective diagram of a portion of the wireless access point 30 with the slot antenna 50 formed therein. FIG. 8 is a schematic diagram of the slot antenna 50, and FIG. 9 is a graph of the S11 parameter illustrating the effect of a capacitive load in FIGS. 7 and 8. In FIG. 7, the slot 14 is formed in the heatsink 54, and the power and RF board 60 has the components 62 including a component 62A adjacent to the slot 14. The component 62A can be capacitors connected to the power and RF board 60 which in turn is connected to the heatsink 54 via a ground screw 70. A gap 72 between the components 62, 62A and the heatsink 56 acts as a capacitive load for the slot 14 which allows the slot 14 to be miniaturized. FIG. 8 is the equivalent circuit diagram of the slot antenna with a capacitor 74 where a capacitive load is imposed by the gap 72. FIG. 9 is a graph 80 of the S11 parameter with a line 82 where L=60 mm without a capacitive load and with a line 84 where L=50 mm with a capacitive load. Thus, the use of the gap 72 forming the capacitive coupling across the slot 14 allows a reduction in the resonant length L.

Additional Resonant Length Miniaturization

Figure 10:
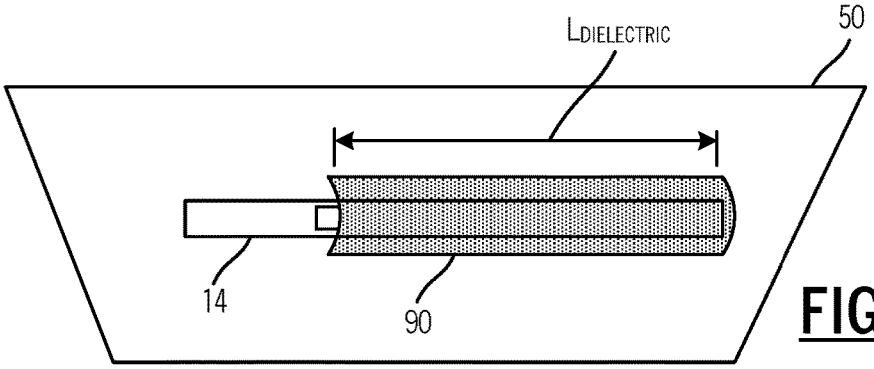
FIG. 10 is a diagram of a slot antenna with a dielectric slab loading the slot.
Figure 11:
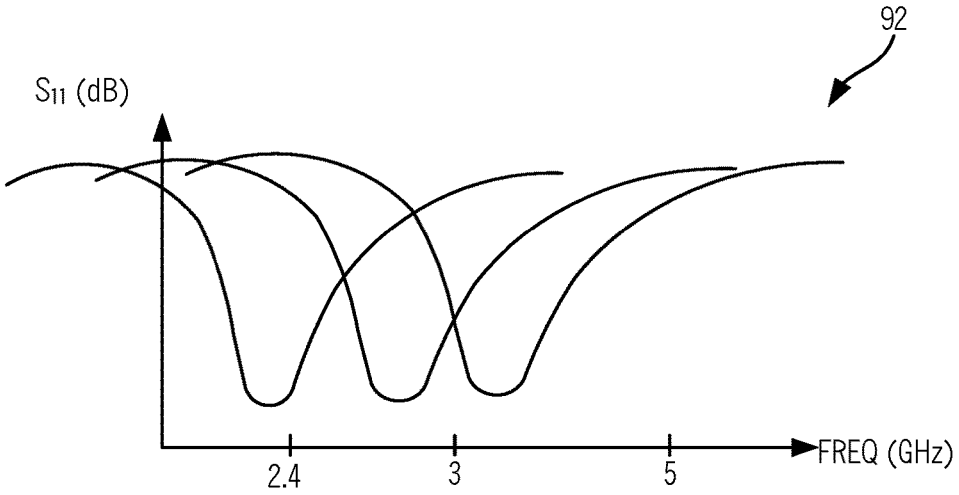
FIG. 11 is a graph of the S11 parameter illustrating the dielectric constant of the dielectric slab of FIG. 10 to reduce the resonant length L.

FIG. 10 is a diagram of the slot antenna 50 with a dielectric slab 90 loading the slot 14 and FIG. 11 is a graph 92 of the S11 parameter illustrating the dielectric constant of the dielectric slab 90 to reduce the resonant length L. In FIG. 10, the slot 14 is partially filled in with the dielectric slab 90 with an associated dielectric constant. The dielectric slab 90 has a resonant length of $L_{dielectric}$. FIG. 11 illustrates the graph 92 where the dielectric constant of the dielectric slab 90 is adjusted as is the resonant length of $L_{dielectric}$. These values can be adjusted to further miniaturize the overall length L of the slot 14. For example, increasing the dielectric constant causes the lines in the graph 92 to move to the left whereas reducing the resonant length of $L_{dielectric}$ causes the lines to move to the right. The dielectric slab 90 is over some portion of the length of the slot 14. The length of the dielectric slab 90 can be easily adjusted in order to fine-tune the frequency of resonance, and the dielectric slab 90 is within the slot 14, rather than just on the outside of the slot 14 (i.e., the dielectric slab 90 has a stronger effect when in the slot 14).

Figure 12:
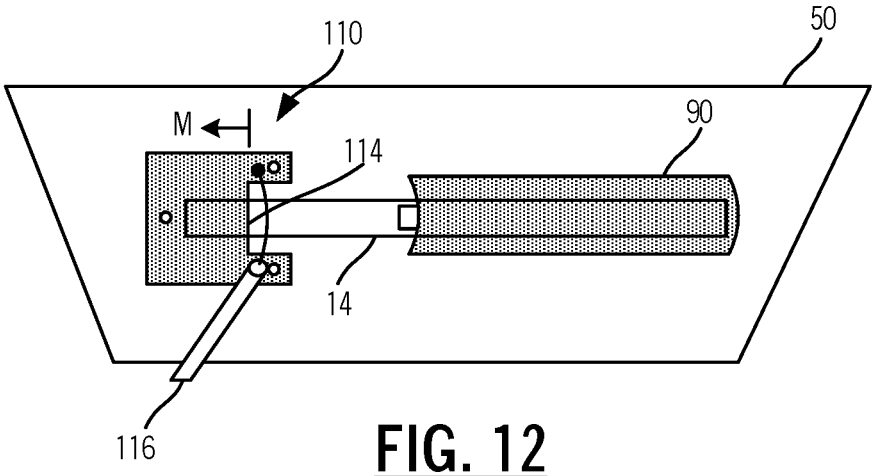
FIG. 12 is a diagram of the slot antenna with the dielectric slab loading the slot and a clip feeding the slot.
Figure 13:
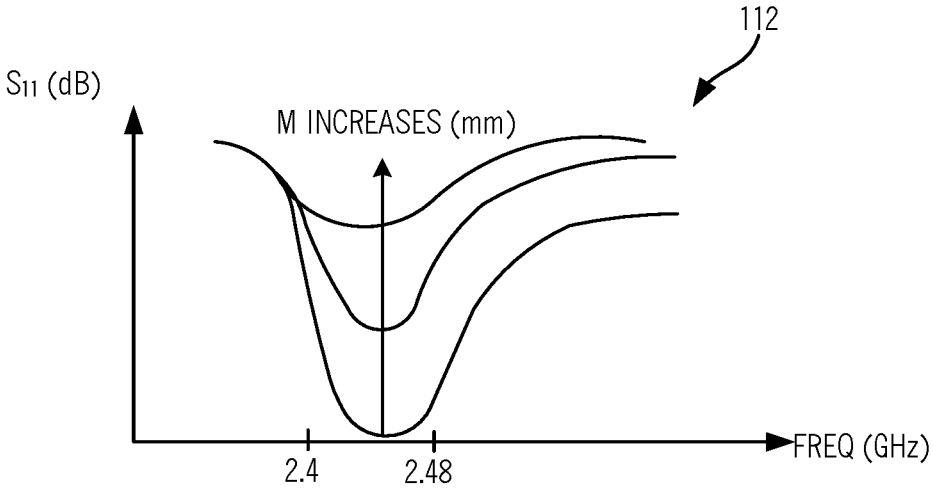
FIG. 13 is a graph of the S11 parameter illustrating the effect of the clip size.

FIG. 12 is a diagram of the slot antenna 50 with the dielectric slab 90 loading the slot 14 and a clip 110 feeding the slot 14. FIG. 13 is a graph 112 of the S11 parameter illustrating the effect of the clip 110 size. The clip 110 is a feed-match clip, and the clip 110 feeds the slot 14 and matches it independently of the slot 14 structure formed by the heatsink 54. The clip 14 includes screws connecting the clip 110 to the heatsink 54, a clip edge 114 over the slot 14, and a coax cable 116 feeding over the clip edge 114. A distance M is defined as the distance of the clip edge 114 to the slot 14 end. FIG. 13 illustrates the graph 112 with the lines showing the effect of increasing a value of M. The clip 114 allows feeding and matching the slot 14 without changing the slot 14 itself.

Figure 14:
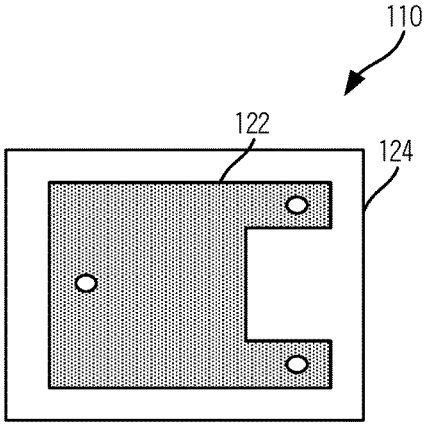
FIG. 14 is a diagram of the clip of FIG. 12.

FIG. 14 is a diagram of the clip 110. The clip 110 can be implemented as a flex with a copper layer 122 on top of a dielectric 124 such as polyimide (PI). The clip 110 is placed over the end of the slot 14 for tuning. The clip 14 can cover a portion of the slot 14, thereby tuning the slot 14. This allows tuning of the slot 14 without modifying the heatsink 54 design, but rather only by modifying dimensions of a portion of the clip 110. The conductive sheet is a thin material that can be shaped easily to change the length of slot 14 to adjust tuning. The clip 110 can be attached with screws or another conductive fastening (adhesive). The clip 110 positioning can be changed, thereby changing electrical length of slot 14. Also, the clip 110 can include an antenna feed for ease of assembly, i.e., via the coax cable 116.

Slot Performance

Figure 15:
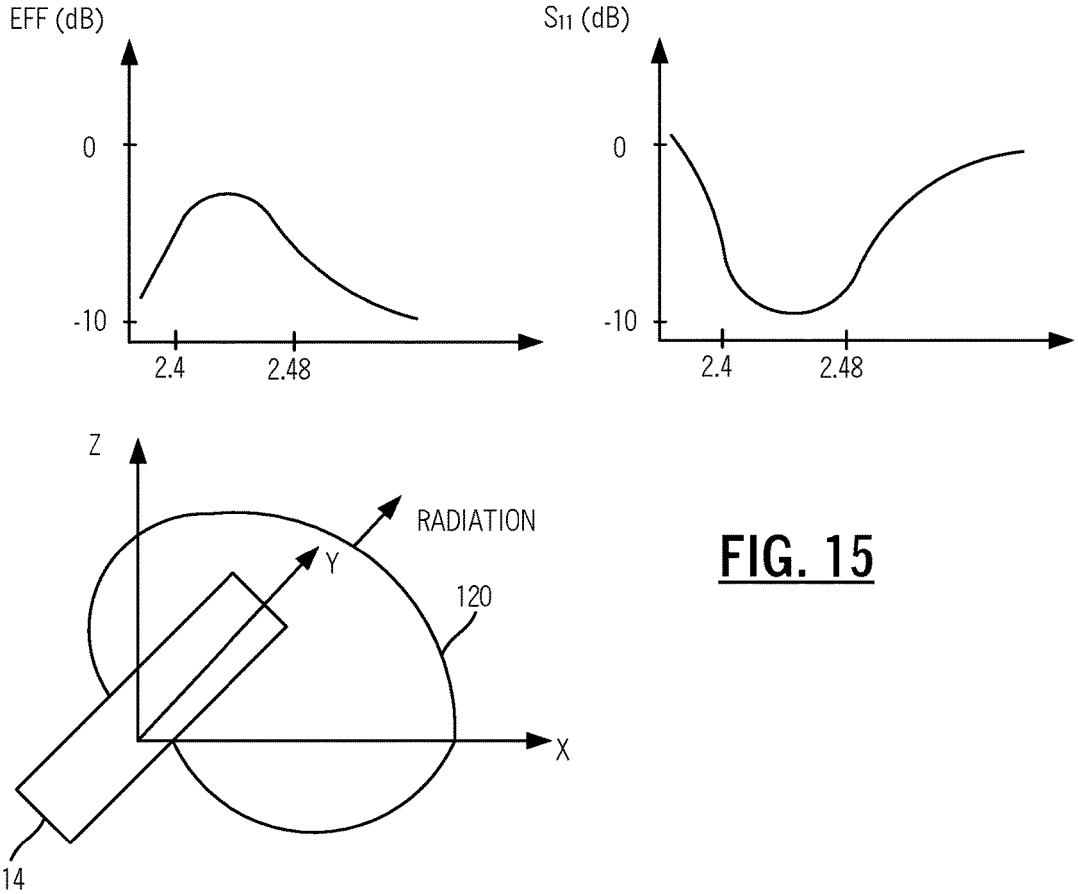
FIG. 15 is graphs of performance of the slot antenna.

FIG. 15 illustrates graphs of the performance of the slot antenna 50. The slot antenna 50 has a highly integrated, formed, constructed slot 14 with an independent feed-match via the clip 110, the dielectric slap 90, and the capacitive loading enabling a miniaturized slot which can be folded that performs close to the ideal slot antenna 10. A radiation pattern 120 is shown relative to the slot 14 in the slot antenna 50. Most radiation is in front of the slot 14, and most of the radiation is linearly polarized perpendicular to the slot 14.

Additionally, the slot 14 can be used as venting intake or exhaust for heat generated from the power and RF board 60. The slot antenna 50 has resonance in both the 2.4 GHz and 5 GHz bands enabling use for Wi-Fi.

Slot Antenna in a Wireless Device

Figure 16:
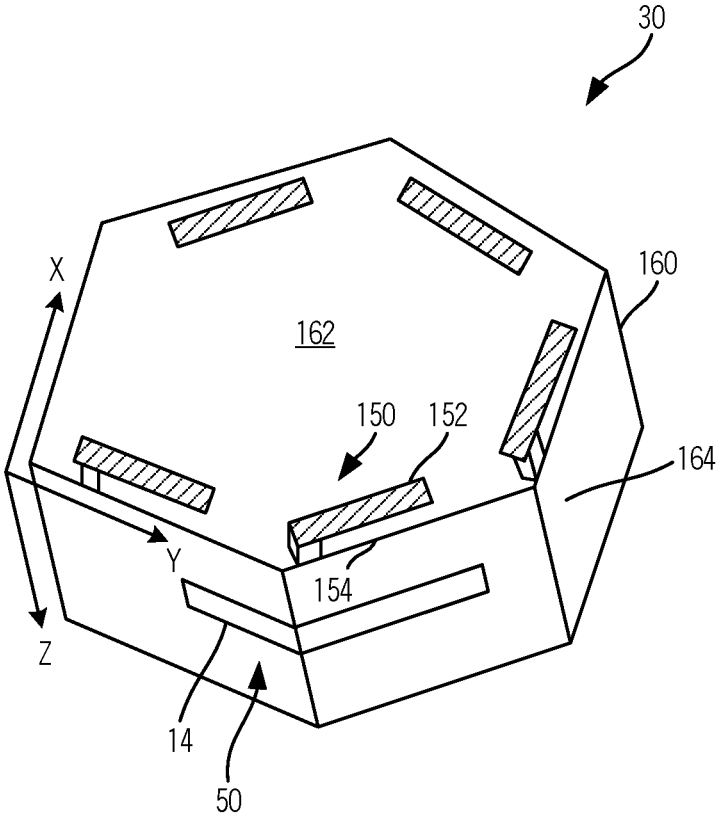
FIG. 16 is a perspective diagram of the wireless access point with the slot antenna and with additional antennas on top of the heatsink.
Figure 17:
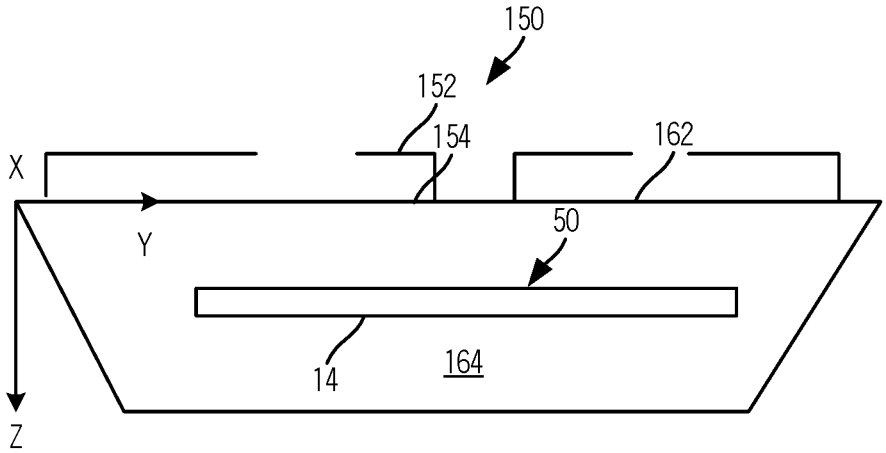
FIG. 17 is a diagram of a side view of the wireless access point of FIG. 16.

FIG. 16 is a perspective diagram of the wireless access point 30 with the slot antenna 50 and with additional antennas 150 on top of the heatsink. FIG. 17 is a diagram of a side view of the wireless access point. The wireless access point 30 can include a heatsink 160 which can be a combination of the heatsinks 52, 54, 56. The antennas 150 can be a planar inverted F (PIFA) antenna which includes an antenna element 152 connected to a ground plane 154. The ground plane 154 can be the heatsink 160. The antennas 150 could also be a monopole, inverted-F antenna (IFA), etc.

The wireless access point 30 can include a top side 162 and side walls 164. The slot antenna 50 is formed with the slot 14 in the side wall 164 of the heatsink 160. The orientation of slot 14 is such that its radiation is orthogonal to the other antennas 150 in the same frequency band in the design to maximize isolation from one another. Thus, the wireless access point 30 can include "traditional" antennas 150 on the top side 162 along with the slot antennas 50 on the side walls 164 to allow orthogonality of polarization that is thin (long dimension of the two types of antennas, when orthogonal goes in the same direction).

All of the antennas 150 on the top side 162 have a polarization in the X-Y plane. All of the slot antennas 50 on the side wall 164 have a polarization in the Z plane. This allows for the wireless access point 30 to be very thin as the slot antenna 50 can be very close to the top antennas 150 and still provide isolation.

Ventilation Via the Slot Antenna

Figure 18:
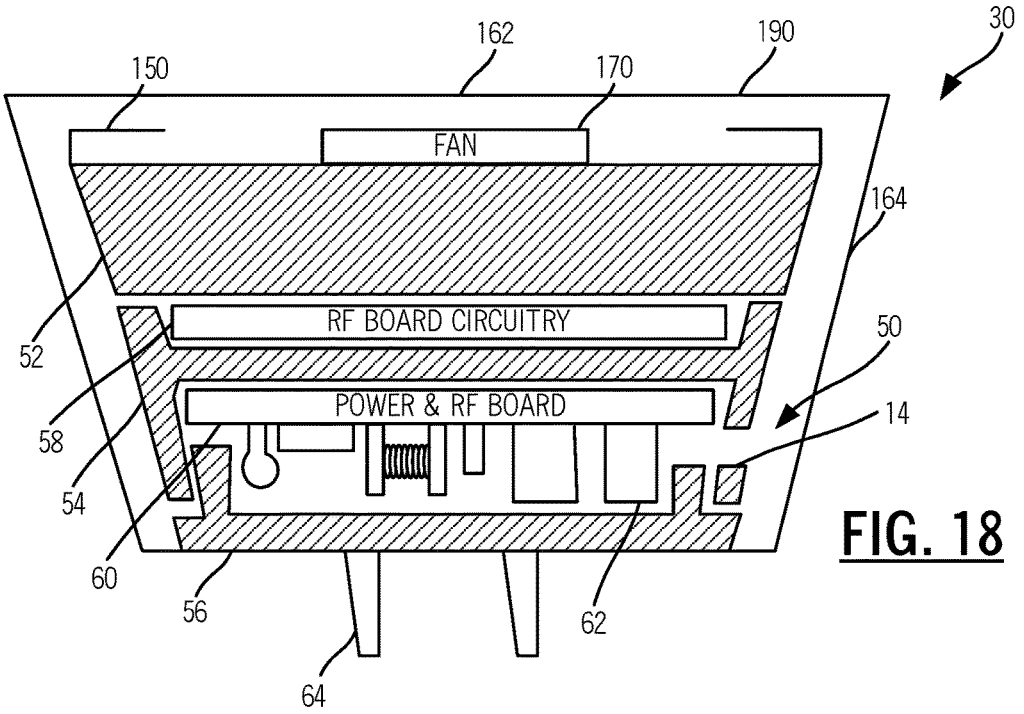
FIG. 18 is a cross-sectional diagram of the wireless access point with the slot antenna, with the additional antennas on top of the heatsink, and a fan.
Figure 19:
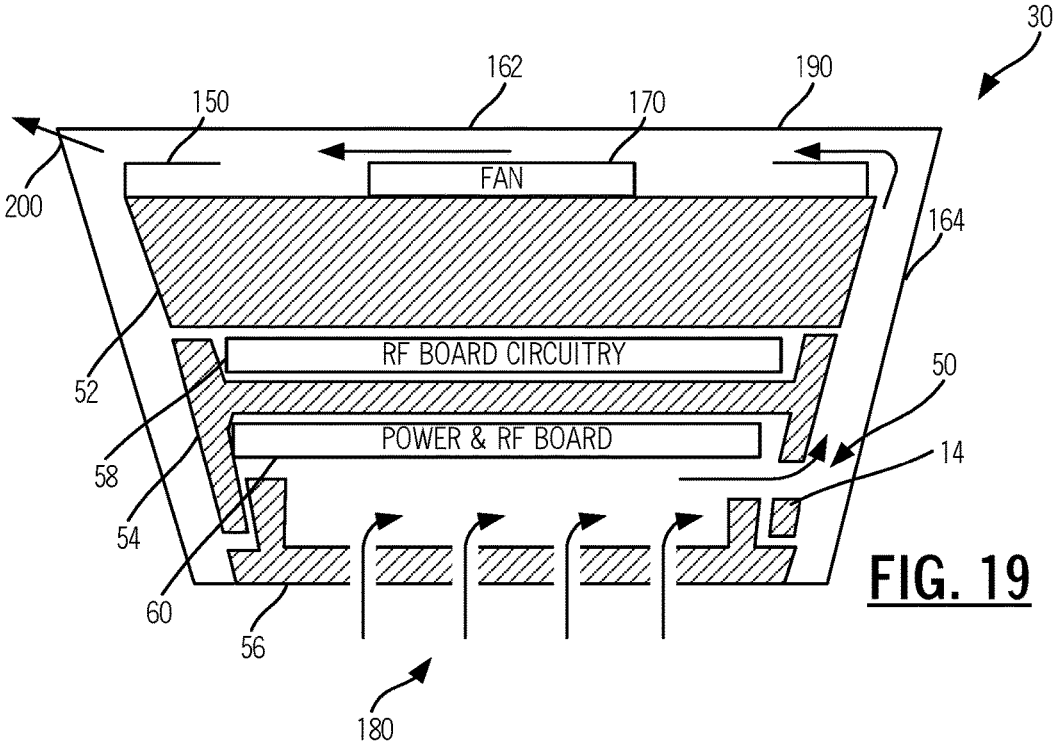
FIG. 19 is a cross-sectional diagram of the wireless access point with air intakes in the bottom heatsink and associated air flow.

FIG. 18 is a cross-sectional diagram of the wireless access point 30 with the slot antenna 50, with the additional antennas 150 on top of the heatsink 160, and a fan 170. FIG. 19 is a cross-sectional diagram of the wireless access point 30 with air intakes 180 in the bottom heatsink 56 and associated air flow. FIGS. 18 and 19 are similar to FIG. 6 with the various components in the wireless access point 30, namely the heatsinks 52, 54, 56, the boards 58, 60, and the components 62 in a product housing 190 (casing, enclosure, etc.). The wall plug 64 can extend out of the housing 190. When plugged in, the top side 162 faces out from the wall outlet along with the antennas 150. The top side 162 can also include the fan 170 which causes airflow through the product housing 190. The slot antenna 50 is on the side wall 164 and can provide ventilation. Also, the slot antenna 50 can use the various aspects described herein for tuning and miniaturization. In FIG. 19, an opening 200 near or at the top side 162 can provide egress for exhaust air which is drawn in from the air intakes 180, out the slot 14, and to the opening 200 via the fan 170.

Wireless Device

In an exemplary embodiment, a wireless device such as the wireless access point 30 includes one or more heatsinks 52, 54, 56, 160; one or more circuit boards 60 with a plurality of components 62 thereon; a housing 190 enclosing the one or more heatsinks 52, 54, 56, 160 and the one or more circuit boards 60; and a slot antenna 50 including a slot formed 14 in or between the one or more heatsinks 52, 54, 56, 160, an antenna feed, and a ground plane 12 formed by the one or more heatsinks 52, 54, 56, 160 which are folded in part, wherein the slot 14 is further utilized for ventilation within the housing 190. One or more components 62A of the plurality of components 62 are used to electrically load the slot 14 thereby mechanically shortening a resonant length L of the slot 14.

The one or more components 62A are adjacent to the slot, and there is an air gap 72 between the components 62A and the one or more heatsinks 52, 54, 56, 160 acting as a capacitor across the air gap 72. The wireless device can further include a clip 110 placed over an end of the slot 14 for tuning. The clip 110 covers a portion of the slot 14 for tuning the based on the selection of dimensions of a portion of the clip 110. The clip 110 is connected to the antenna feed such as via a coax cable 116. The wireless device can further include a dielectric material 90 disposed in and over some portion of the length of the slot 14, wherein the portion of the length is selected to fine tune a frequency of resonance of the slot antenna 50. The wireless device can include the clip 110 placed over an end of the slot 14 for tuning; and the dielectric material 90 disposed in and over some portion of length of the slot 14, wherein the portion of the length is selected to fine tune a frequency of resonance of the slot antenna 50, wherein one or more components 62A of the plurality of components 62 are used to electrically load the slot 14 thereby mechanically shortening a resonant length L of the slot 14.

The wireless device can include one or more additional antennas 150, wherein an orientation of the slot 14 is such that the slot antenna's radiation is orthogonal to the one or more additional antennas 150 which are in the same frequency band. The one or more additional antennas 150 can include any of a planar inverted F antenna (PIFA), an inverted F antenna (IFA), and a monopole antenna. The one or more additional antennas 150 are on a top side 162 of the one or more heatsinks 52, 54, 56, 160 and the slot antenna 50 is on a side wall 164 of the one or more heatsinks 52, 54, 56, 160. A required resonant length L of the slot 14 can be about 60 mm and is mechanically shortened to about 50 mm with a capacitive load on the slot 14. The slot antenna 50 can have resonant frequencies in both the 2.4 GHz frequency band and the 5 GHz frequency band. The wireless device can further include a fan 170, one or more air intakes 180, and a ventilation point 200 in the housing 190, wherein airflow in the housing utilizes the slot for ventilation.

In another exemplary embodiment, the wireless access point 30 includes one or more heatsinks; one or more circuit boards with a plurality of components thereon for Wi-Fi functionality; a housing enclosing the one or more heatsinks and the one or more circuit boards; a slot antenna including a slot formed in or between the one or more heatsinks, an antenna feed, and a ground plane formed by the one or more heatsinks which are folded in part, wherein the slot is further utilized for ventilation within the housing; and one or more additional antennas, wherein an orientation of the slot is such that the slot antenna's radiation is orthogonal to the one or more additional antennas which are in a same frequency band.

It will be appreciated that some exemplary embodiments described herein may include one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the exemplary embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various exemplary embodiments.

Moreover, some exemplary embodiments may include a non-transitory computer-readable storage medium having computer readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various exemplary embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A wireless device with a slot antenna, the wireless device comprising:

one or more heatsinks;

one or more circuit boards with a plurality of components thereon;

a housing enclosing the one or more heatsinks and the one or more circuit boards; and a slot antenna comprising a slot formed in or between the one or more heatsinks and an antenna feed, wherein the slot is further utilized for ventilation within the housing, wherein one or more components of the plurality of components are used to electrically load the slot thereby shortening a resonant length L of the slot, and wherein the one or more components are adjacent to the slot and there is an air gap between the components and the one or more heatsinks acting as a capacitor across the air.

2. The wireless device of claim 1, further comprising:

a conductive sheet placed over an end of the slot for tuning.

3. The wireless device of claim 2, wherein the conductive sheet covers a portion of the slot for tuning the tuning based on selection of dimensions of a portion of the conductive sheet.

4. The wireless device of claim 2, wherein the conductive sheet is connected to the antenna feed.

5. The wireless device of claim 2, wherein the conductive sheet is mounted in a varied position to change an electrical length of the slot.

6. The wireless device of claim 1, further comprising:

a dielectric material disposed in or over some portion of length of the slot, wherein the portion of the length is selected to fine tune a frequency of resonance of the slot antenna.

7. The wireless device of claim 1, further comprising:

a conductive sheet placed over an end of the slot for tuning; and a dielectric material disposed in and over some portion of length of the slot, wherein the portion of the length is selected to fine tune a frequency of resonance of the slot antenna, wherein one or more components of the plurality of components are used to electrically load the slot thereby mechanically shortening a resonant length L of the slot.

8. The wireless device of claim 1, further comprising:

one or more additional antennas, wherein an orientation of the slot is such that the slot antenna's radiation is largely orthogonal to the one or more additional antennas which are in a same frequency band.

9. The wireless device of claim 8, wherein the one or more additional antennas comprise any of a planar inverted F antenna (PIFA), an inverted F antenna (IFA), and a monopole antenna.

10. The wireless device of claim 8, wherein the one or more additional antennas are on a top side of the one or more heatsinks and the slot antenna is on a side wall of the one or more heatsinks.

11. The wireless device of claim 1, wherein a required resonant length L of the slot is about 60 mm and is mechanically shortened to about 50 mm with a capacitive load on the slot.

12. The wireless device of claim 1, wherein the slot antenna has resonant frequencies in both the 2.4 GHz frequency band and the 5 GHz frequency band.

13. The wireless device of claim 1, further comprising:

a fan, one or more air intakes, and a ventilation point in the housing, wherein airflow in the housing utilizes the slot for ventilation.

14. A wireless device with a slot antenna, the wireless device comprising:

one or more heatsinks;

one or more circuit boards with a plurality of components thereon;

a housing enclosing the one or more heatsinks and the one or more circuit boards; and a slot antenna comprising a slot formed in or between the one or more heatsinks, an antenna feed, and a conductive sheet placed over an end of the slot for tuning, wherein the conductive sheet is connected to the one or more heat sinks using screws or conductive adhesive.

15. The wireless device of claim 14, wherein the conductive sheet covers a portion of the slot for tuning the tuning based on selection of dimensions of a portion of the conductive sheet.

16. The wireless device of claim 14, wherein the conductive sheet is connected to the antenna feed.

17. A wireless device with a slot antenna, the wireless device comprising:

one or more heatsinks;

one or more circuit boards with a plurality of components thereon;

a housing enclosing the one or more heatsinks and the one or more circuit boards;

a slot antenna comprising a slot formed in or between the one or more heatsinks and an antenna feed, wherein the slot is further utilized for ventilation within the housing; and one or more additional antennas, wherein an orientation of the slot is such that the slot antenna's radiation is largely orthogonal to the one or more additional antennas which are in a same frequency band, wherein the one or more additional antennas are on a top side of the one or more heatsinks and the slot antenna is on a side wall of the one or more heatsinks.

18. The wireless device of claim 17, wherein the one or more additional antennas comprise any of a planar inverted F antenna (PIFA), an inverted F antenna (IFA), and a monopole antenna.

19. The wireless device of claim 17, further comprising:

a conductive sheet placed over an end of the slot for tuning.

20. The wireless device of claim 17, wherein one or more components of the plurality of components are used to electrically load the slot thereby shortening a resonant length L of the slot.

* * * * *